US009788696B2

(12) United States Patent
Guinot et al.

(10) Patent No.: US 9,788,696 B2
(45) Date of Patent: Oct. 17, 2017

(54) VACUUM CLEANER HEAD

(71) Applicant: SEB S.A., Ecully (FR)

(72) Inventors: Thierry Guinot, Rouen (FR); Alain Soen, Saint-Marcel (FR)

(73) Assignee: SEB S.A., Ecully (FR)

( * ) Notice: Subject to any disclaimer, the term of this patent is extended or adjusted under 35 U.S.C. 154(b) by 651 days.

(21) Appl. No.: 14/347,081

(22) PCT Filed: Sep. 25, 2012

(86) PCT No.: PCT/FR2012/052147

§ 371 (c)(1),
(2) Date: Mar. 25, 2014

(87) PCT Pub. No.: WO2013/045818

PCT Pub. Date: Apr. 4, 2013

(65) Prior Publication Data

US 2015/0074940 A1 Mar. 19, 2015

(30) Foreign Application Priority Data

Sep. 28, 2011 (FR) ..... 11 58711

(51) Int. Cl.

| | |
|---|---|
| ***A47L 9/04*** | (2006.01) |
| ***A47L 9/06*** | (2006.01) |
| *A47L 5/26* | (2006.01) |

(52) U.S. Cl.

CPC ..... *A47L 9/0626* (2013.01); *A47L 9/04* (2013.01); *A47L 9/0466* (2013.01); *A47L 5/26* (2013.01)

(58) Field of Classification Search

CPC ..... A47L 9/0626; A47L 9/0466; A47L 5/26
USPC ..... 15/41.1, 42, 44
See application file for complete search history.

(56) References Cited

U.S. PATENT DOCUMENTS

| | | | | |
|---|---|---|---|---|
| 6,006,402 | A * | 12/1999 | Maurer | A47L 9/04 15/383 |
| 8,424,151 | B2 * | 4/2013 | Lee | A47L 5/30 15/319 |
| 2002/0129462 | A1 * | 9/2002 | Matusz | A47L 5/30 15/384 |
| 2005/0066471 | A1 | 3/2005 | Miller et al. | |
| 2005/0235440 | A1 * | 10/2005 | Rosenzweig | A47L 11/33 15/52.1 |
| 2007/0061999 | A1 * | 3/2007 | Smith | A47L 9/04 15/387 |

(Continued)

FOREIGN PATENT DOCUMENTS

| | | | |
|---|---|---|---|
| DE | 4304681 | A1 | 8/1994 |
| DE | 202011108345 | U1 | 3/2012 |

(Continued)

*Primary Examiner* — Michael Jennings
(74) *Attorney, Agent, or Firm* — The Webb Law Firm

(57) ABSTRACT

Vacuum cleaner head (100) comprising a bottom sole (10) and wheels (30, 35) defining the ground clearance of the bottom sole and comprising at least one suction duct (20) open toward the ground and converging from an outer edge of the bottom sole (10) toward a suction orifice (15) connected to the vacuum cleaner, characterized in that the suction head comprises a sealing skirt (40) arranged around the periphery of the bottom sole (10), and in that the sealing skirt (40) has at least one opening (45) positioned opposite said at least one suction duct (20).

9 Claims, 1 Drawing Sheet

(56) References Cited

U.S. PATENT DOCUMENTS

| | | | | |
|---|---|---|---|---|
| 2007/0143954 | A1* | 6/2007 | Graham | A47L 9/0477 15/364 |
| 2009/0133213 | A1* | 5/2009 | Pineschi | A47L 9/0411 15/383 |
| 2010/0257695 | A1* | 10/2010 | MaGuire | A47L 9/009 15/415.1 |
| 2010/0257696 | A1* | 10/2010 | MaGuire | A47L 9/06 15/415.1 |
| 2010/0306958 | A1* | 12/2010 | Follows | A47L 9/0477 15/383 |
| 2011/0010886 | A1* | 1/2011 | Arthey | A47L 9/0494 15/363 |
| 2012/0144621 | A1* | 6/2012 | Forbes | A46B 13/008 15/389 |

FOREIGN PATENT DOCUMENTS

| | | | | |
|---|---|---|---|---|
| EP | 0353546 | A1 | 2/1990 | |
| EP | 1222892 | A1 | 7/2002 | |
| EP | 2014212 | A1 | 1/2009 | |
| EP | 2201876 | A1 | 6/2010 | |
| FR | WO 9935952 | A1 * | 7/1999 | A47L 9/02 |

* cited by examiner

VACUUM CLEANER HEAD

CROSS-REFERENCE TO RELATED APPLICATIONS

This application is the United States national phase of International Application No. PCT/FR2012/052147 filed Sep. 25, 2012, and claims priority to French Patent Application No. 1158711 filed Sep. 28, 2011, the disclosures of which are hereby incorporated in their entirety by reference.

BACKGROUND OF THE INVENTION

Field of the Invention

The present invention relates in general to a vacuum cleaner head equipped with a skirt.

Description of Related Art

Vacuum cleaner heads such as the one described in U.S. Patent 2005 0066471 A1 are known to the prior art. The suction head disclosed therein comprises a sealing lip comprising openings that let air flow into the suction head. However, this system in particular has the disadvantage of not being effective for vacuuming dirt from the floor because the air speeds are not controlled in the suction head. Furthermore, the suction head is not correctly positioned in relation to the floor because a U-shaped part positioned in the center of the suction head does not prevent it from tilting, hence the sealing lip does not function in a consistent manner.

European Patent 2 014 212 A 1 in turn discloses a vacuum cleaner head equipped with a floor cloth and used with a machine for vacuuming and washing floors. This suction head is equipped with a sealing lip on the front, which increases the adhesion force of the suction head against the floor for wiping it. However, the use of this suction head for washing renders it unsuitable for use on a floor that cannot tolerate water, such as certain wood parquets or carpets made of non-washable fibers, and using it without water will not obtain effective suction. Lastly, this suction head is not suitable for vacuuming with just air because the bottom sole is in direct contact with the floor, which causes rubbing that generates resistance to movement as well as noises that are detrimental to user comfort.

Lastly, European Patent 1 222 892 B1 discloses a suction head with a grooved sole mounted on wheels; however, air leaks arise between the sole and the floor in such a way that the suction is ineffective because the air speeds are less than optimal in the grooves. In a second embodiment, the grooved sole is in direct contact with the floor, but this causes noisy rubbing and increases the effort that must be exerted to move the suction head. These two points are detrimental to the user comfort and ergonomics of the proposed appliance.

An object of the present invention is to address the disadvantages of the above-mentioned prior art documents and in particular, firstly to propose a vacuum cleaner head with effective suction.

SUMMARY OF THE INVENTION

To this end, a first aspect of the invention relates to a vacuum cleaner head comprising a bottom sole and wheels defining the ground clearance of the bottom sole and comprising at least one suction duct open toward the floor and converging from an outer edge of the bottom sole toward a suction orifice connected to the vacuum cleaner, characterized in that the suction head comprises a sealing skirt arranged around the periphery of the bottom sole, and in that the sealing skirt comprises at least one opening positioned opposite said at least one suction duct. The sealing skirt of the invention gives rise to effective suction because it is arranged around the periphery of the sole and stops air leaks, and the opening positioned opposite the duct causes the air flow to be directed into said duct for effectively vacuuming dirt from the floor. In other words, the suction head, and hence the bottom sole of the suction head, is positioned at a preset height from the floor by the wheels, and the skirt positioned properly and arranged around the periphery of the sole confers a seal to the suction head, except at the openings positioned opposite each duct, thus channeling the air flow directly into the ducts for effectively vacuuming dust. Obviously, the ground clearance is understood as being defined in relation to a smooth and non-deformable floor, such as a parquet or tile floor, for example. Ideally, the skirt is arranged around the entire periphery of the bottom sole.

The sealing skirt advantageously has an elasticity for bending as the suction head is moved over a carpet in such a way that the suction head is able to sink into the carpet. The suction head of the present invention also makes it possible to clean a carpet effectively. Indeed, the skirt is sufficiently elastic to allow the suction head to sink into the carpet to be cleaned. Without any action on his or her part, a user can clean a smooth floor perfectly and then move on to cleaning a carpet or rug placed on the floor. The skirt, which bends during movements, is not detrimental to comfort because there is no friction; it glides over the carpet.

The suction head advantageously comprises a rotary brush. Such a suction head in combination with the elastic skirt makes it possible to clean a carpet even more effectively, as the sinking into the carpet will enable a better brushing of the latter than if the suction head did not sink.

The bottom sole advantageously comprises at least one chamfer designed to allow the sealing skirt to bend as the suction head moves over the carpet. The sole comprises a chamfer, which facilitates the clearance of the skirt when it bends.

In a particularly interesting embodiment, said at least one chamfer serves as a mechanical stop for the sealing skirt bent by a movement of the suction head in a first direction. This arrangement makes it possible to control the movement of the skirt in a first direction of movement.

The bottom sole advantageously comprises at least one mechanical stop for the sealing skirt bent by a movement in a second direction opposite the first direction. This arrangement makes it possible to control the movement of the skirt in a second direction of movement opposite the first direction of movement.

The wheels advantageously comprise a tread designed for defining contact pressures with the carpet that induce the sinking of the suction head into the carpet. In other words, the wheels are designed to induce contact pressures greater than those which the carpet is able to withstand without deforming. In a non-limiting manner, the wheels can be configured with a barrel shape in order to limit their contact surface with the floor, which will give rise to a small contact surface with the carpet and thus a sinking of the suction head into the carpet.

Advantageously, said at least one opening of the unbent sealing skirt defines a first air passage section, and the curvature of the sealing skirt defines a second air passage section. The skirt of the invention thus defines two operating points of the vacuum cleaner by imposing a first passage section on smooth floors when it is not bent and a second passage section on carpeting when it is bent.

Advantageously, at least a portion of the sealing skirt is parallel to a forward or backward movement direction of the suction head and this parallel portion is preshaped to bend toward the outside of the bottom sole of the suction head as the suction head sinks into the carpet. The skirt of the invention is preshaped to bend in a preferential direction in such a way that the suction head will easily sink into the carpet.

A second aspect of the invention is a vacuum cleaner comprising at least one suction head according to the first aspect of the invention.

BRIEF DESCRIPTION OF THE DRAWINGS

Other features and advantages of the present invention will emerge more clearly upon reading the following detailed description of an embodiment of the invention, which is given as an example not limiting in any way and illustrated by the appended drawings, wherein:

FIG. 1 shows a vacuum cleaner head 100 according to the invention. It comprises a bottom sole 10 with a plurality of suction ducts 20 open toward the floor. The suction head also comprises wheels 30, 35, the tread profile of which is barrel-shaped and defines the ground clearance of the sole 10 when the suction head is resting on a smooth floor. The suction head has the general shape of a triangle and at least one of the ducts 20 opens in the point of the suction head. Each duct 20 connects a suction orifice 15 (which can be in the form of a slot) to the outside of the sole 10 in such a way that the air sucked in by the motor of the vacuum cleaner preferentially travels in the ducts of the sole. In order to achieve effective suction, the invention in particular proposes arranging a sealing lip or sealing skirt 40 around the sole. This sealing skirt 40 prevents leaks between the smooth floor and the sole 10, and for achieving effective suction, the sealing skirt 40 is open opposite the ducts 20 in such a way that the air sucked under the sole 10 can only enter the ducts 20 directly by way of openings 45 on the sealing sheet. Effective suction of the dirt from the floor is thus achieved because the air speeds in the ducts 20 are maximized, as all of the air sucked in passes through them.

FIG. 2 is a side view of the suction head 100 on a smooth floor. The wheels 30, 35 (the latter are hidden by the sealing skirt) position the suction head 100 in height relative to the flat, uncarpeted floor. The sealing skirt 40 skims the flat floor in such a way that air is prevented from leaking out between the floor and the bottom sole 10, and openings 45 of the sealing skirt 40 positioned directly opposite the suction ducts 20 let air pass into the latter for removing dirt lying on the floor.

FIG. 3 is a cutaway view of the suction head of FIG. 1 along the section line III-III in use on a carpet 200. The suction head 100 is pushed forward (in the direction of the arrow) by the user; due to the barrel-shaped profile of the wheels 30, 35 high contact pressures are exerted on the carpet 200, which permits the suction head to sink into the carpet, and the sufficiently elastic sealing skirt 40 bends. A chamfer 11 on the front of the sole allows the sealing skirt 40 to bend and simultaneously serves as a stop for the latter. Hence the position of the skirt is precise and it is able to glide over the carpet without creating any resistance detrimental to movement. At the back of the bottom sole, the sealing skirt 40 also bends and provision is made of a mechanical stop 12 for restricting the bending of the skirt 40. According to the variant illustrated, a chamfer 11 is likewise present on the back of the sole and a mechanical stop 12 is positioned on the front of the sole of the suction head. A rotary brush (60) is arranged in the suction slot 15, and the carpet is effectively brushed because the suction head, due to the elasticity of the sealing skirt, sinks adequately into the carpet.

Figure 1:
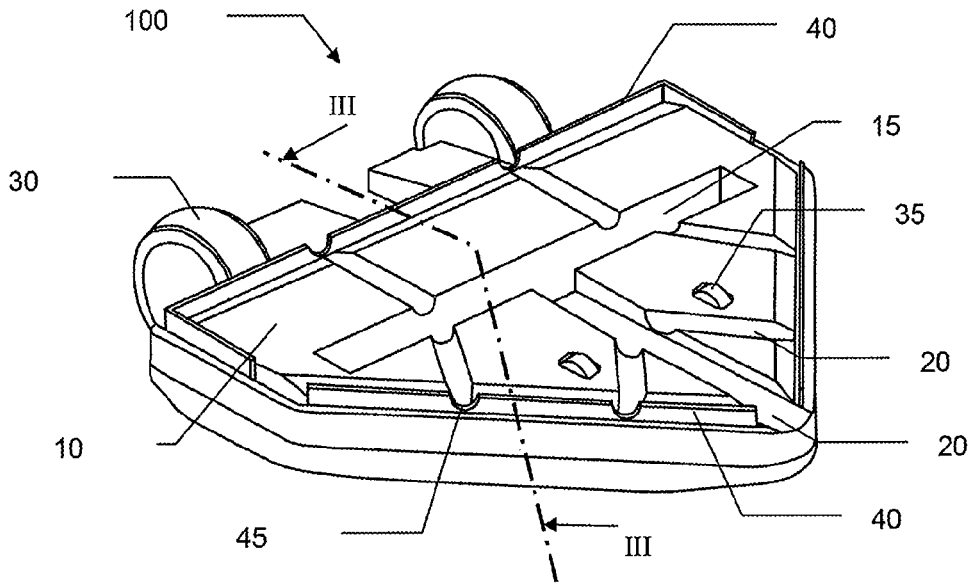
FIG. 1 shows a suction head of the invention, viewed in perspective from below.
Figure 2:
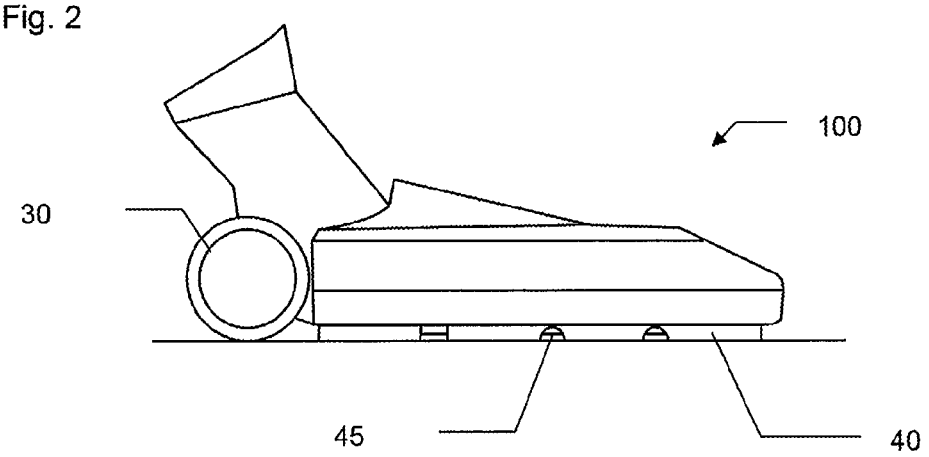
FIG. 2 shows the suction head of FIG. 1 positioned on a smooth floor, viewed from the side.
Figure 3:
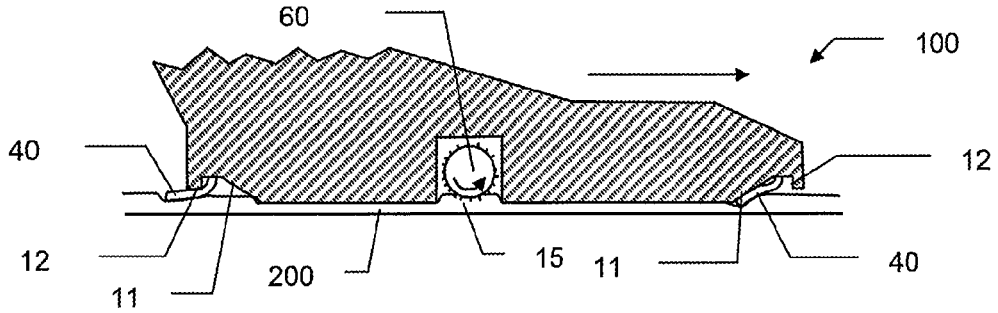
FIG. 3 is a cross-sectional view of the suction head taken along section line III of FIG. 1, traversing a carpet.

It should be understood that diverse modifications and/or improvements obvious to a person skilled in the art may be made to the embodiment of the invention described in this description without going beyond the scope of the invention defined by the appended claims.

The invention claimed is:

1. A vacuum cleaner having a suction head comprising a bottom sole and wheels defining a ground clearance of a bottom sole and comprising a plurality of suction ducts open toward a floor and converging from an outer edge of the bottom sole toward a suction orifice connected to the vacuum cleaner, wherein the suction head has a generally triangular shape and further comprises a sealing skirt arranged around the outer edge of the bottom sole, and wherein the sealing skirt comprises openings that the suction ducts extend from and wherein at least one of the ducts opens in the point of a middle suction head and extends to the suction orifice.

2. Vacuum cleaner having a suction head as in claim 1, wherein the sealing skirt has an elasticity for bending as the suction head is moved over a carpet in such a way that the suction head can sink into the carpet.

3. Vacuum cleaner having a suction head as in claim 2, wherein the bottom sole comprises at least one chamfer to permit the sealing skirt to bend as the vacuum head is moved over the carpet.

4. Vacuum cleaner having a suction head as in claim 3, wherein said at least one chamfer serves as a mechanical stop for the sealing skirt bent by a movement of the vacuum head in a first direction.

5. Vacuum cleaner having a suction head as in claim 4, wherein the bottom sole comprises at least one mechanical stop for the sealing skirt bent by a movement of the suction head in a second direction opposite to the first direction.

6. Vacuum cleaner having a suction head as in claim 2, wherein the wheels comprise a tread designed in a barrel shape to induce the sinking of the suction head into the carpet.

7. Vacuum cleaner having a suction head as in claim 2, wherein said at least one opening of the sealing skirt defines a first air passage section and in that the curvature of the sealing skirt defines a second air passage section.

8. Vacuum cleaner having a suction head as in claim 2, wherein at least a portion of the sealing skirt is parallel to a forward or backward movement direction of the suction head and wherein in such parallel portion said sealing skirt is preshaped to bend toward an outside of the bottom sole of the suction head as the suction head sinks into the carpet.

9. Vacuum cleaner having a suction head as in claim 1, wherein the vacuum head comprises a rotary brush.

* * * * *